US005199668A

United States Patent [19]

Swaney, Jr.

[11] Patent Number: 5,199,668

[45] Date of Patent: Apr. 6, 1993

[54] LAUNCHER FOR RADIO CONTROLLED FLIGHTS OF A MODEL AIRPLANE, RELEASING THE MODEL AIRPLANE FOR FLIGHT UPON DEPRESSING A FOOT PEDAL THEREOF

[76] Inventor: Matthey A. Swaney, Jr., P.O. Box 391, Morrilton, Ark. 72110

[21] Appl. No.: 824,576

[22] Filed: Jan. 23, 1992

[51] Int. Cl.[5] ..... B64C 25/68; A63H 27/14; B64F 1/16

[52] U.S. Cl. ..... 244/110 R; 244/63; 446/429

[58] Field of Search ..... 244/110 A, 110 C, 110 R, 244/63; 446/34, 429; 248/156

[56] References Cited

U.S. PATENT DOCUMENTS

| | | | |
|---|---|---|---|
| 2,672,306 | 3/1954 | Doolittle et al. | 244/110 A |
| 2,957,651 | 10/1960 | Figgins et al. | 244/63 |
| 3,154,883 | 11/1964 | Gardeila | 244/63 |
| 3,232,564 | 2/1966 | Benson | 446/34 |
| 4,016,674 | 4/1977 | Resnick et al. | 446/429 |
| 4,169,333 | 10/1979 | St. Clair | 446/39 |
| 4,993,672 | 2/1991 | Hasage | 244/110 R |
| 5,028,015 | 7/1991 | Moses et al. | 446/34 |

*Primary Examiner*—Joseph F. Peters, Jr.
*Assistant Examiner*—Virna Lissi Ansley
*Attorney, Agent, or Firm*—Roy E. Mattern, Jr.

[57] ABSTRACT

A launcher for radio controlled flights of a model airplane, which releases the previously restrained model airplane upon the depression of a foot pedal thereof, thereby eliminating the need for any person to place his or her head in or nearby the exhaust stream of the operating engine at takeoff time, supporting: rotatable, releasible, restraining, spaced, arms, which, when raised, obstruct the forward motion of the model airplane, via the stabilizers thereof; the foot pedal; and a linkage system interconnecting the foot pedal with the rotatable, releasible, restraining, spaced arms.

22 Claims, 4 Drawing Sheets

LAUNCHER FOR RADIO CONTROLLED FLIGHTS OF A MODEL AIRPLANE, RELEASING THE MODEL AIRPLANE FOR FLIGHT UPON DEPRESSING A FOOT PEDAL THEREOF

BACKGROUND

The launchers for radio controlled flights of model airplanes have previously been provided to hold a model airplane in place before takeoff, during a time when a pilot is checking out the engine performance, and, as necessary, other performance functions as well.

In 1979, Oba L. St. Clair in his U.S. Pat. No. 4,169,333 illustrated and described his Model Aircraft Launcher for releasing a self-propelled model aircraft at a remote location, upon pulling on a control cord of the launcher. When this control cord was pulled, a release member of the launcher was slidably moved over a portion of a spring arm, finally disengaging this spring arm into a released position, thereby clearing and releasing a short retarding line holding a rear portion of the fuselage of the model aircraft, which was then ready for takeoff.

In 1991, Fred G. Hosage in his U.S. Pat. No. 4,993,672, illustrated and described his Safety Retainer For Model Airplanes. A U-shaped member was inserted into the ground. Then, via hinges, a hinged member was secured to it and arranged for rotation only in one direction opposite to the starting flight direction of the model airplane. Portions of the hinged member, when raised, retained the stabilizers of the model airplane. When the model airplane was ready for flight, a person pulled the model airplane back so the portions of the hinged member would rotate down clear of the stabilizers. Then when the person released the model airplane it was cleared for takeoff.

Mr. St. Clair provided his launcher to avoid the necessity of having an assisting person hold the model airplane while remaining in the exhaust stream of the engine. This person or the pilot standing at a remote location, upon pulling on the releasing-control cord, could clear the model airplane for takeoff. Mr Hosage did not provide this advantage for the assisting person or the pilot. Either one would have to be positioned to the rear of the model airplane to withdraw it, thereby allowing the raised portions of the hinged member to rotate down to ground level, clearing the model airplane for takeoff. However, Mr. Hosage did provide pivotal raised portions, which conveniently contacted the stabilizers of the model airplane when flight preparations were underway.

There remained a need for an improved launcher of model airplanes which did not require any person to subject himself or herself to the engine exhaust stream during flight preparations, and which would meet all of the necessary safety considerations.

SUMMARY

A launcher is staked to the ground and thereafter used during radio controlled flights of a model airplane. The launcher securely holds the model airplane, until a foot pedal thereof is firmly and completely depressed and so held, as the model airplane clears the launcher. By using this launcher, neither the pilot, an observer, or any other person, needs to remain close enough to a model airplane, while he or she restrains it during flight preparations thereof. Therefore, no person will be subjected to the extreme noise of the aircraft engine or to the hot and dirty exhaust stream, departing from the aircraft engine of the model airplane prior to the taxiing and takeoff thereof.

Preferably the launcher has a horseshoe-like spaced base, supporting: rotatable, releasible, restraining, spaced arms, which when raised, obstruct the forward motion of the model airplane, via holding of the stabilizers thereof; a foot pedal; and a linkage system interconnecting the foot pedal with the rotatable, releasible, restraining, spaced arms.

When the foot pedal is depressed and held, pivotal locking levers of the linkage system are pivoted against a spring force, to be moved clear of the rotatable, releasible, restraining, arms. These arms are then easily, rotatably moved in the direction of flight, by the stabilizers of the model airplane, when being moved forward by the power of its operating engine and the thrust created upon the revolving of the propeller. These arms continue to rotate, reaching a horizontal position well clear of the model airplane.

In preparation for the follow on flight, the rotatable, releasible, restraining, arms, are rotated back up over center, and then the pivotal locking levers of the linkage system, via their return spring forces, lock them in place to again hold the stabilizers of the model airplane, during flight preparations. When the launcher is removed from the ground to be taken to the vehicle and/or the home of the pilot, the rotatable, releasible, restraining arms, are preferably rotated in the direction opposite to the flight direction and moved down into the launcher and so held via spring force catches.

By using this launcher, the advantages are, in addition to keeping all persons clear of the exhaust stream and the extreme noise level, the pilot makes his or her adjustments of the engine knowing the model airplane will not move. Previously, when other persons had to hold a model airplane, if they moved a slight amount, the pilot or person adjusting the engine could possibly have his or her fingers hurt by the rotating propeller. Also the pilot now has oomplete oontrol of his or her model airplane. Moreover, the launcher, after the model airplane taxies away and takes off, has all of the portions thereof arranged closely to the ground, thereby keeping them clear of any low flying model airplanes. Very importantly, this launcher involves the mechanical positive release of a model airplane for taxi or takeoff, thereby complying with the Academy of Model Aeronautics safety requirements, particularly in reference to the requirement that a pilot or operator must be in complete control of the model airplane. This mechanical positive release, occurring when using this launcher, prevents any inadvertent transmitter signal from releasing the model airplane for taxi or takeoff, when the pilot or operator is not ready for his or her model airplane to be moved.

By using the preferred horseshoe like spaced base, with the toe of the horseshoe being the location of the foot pedal, and with the space heel portions of the horseshoe being pointed in the direction of the taxiing or flight, then a model airplane with a tail wheel is accommodated as the tail wheel moves in the space between the spaced heel portions. Moreover, the launcher is adaptable to holding a wide range of sizes and types of model airplanes, while they are prepared for taxiing and takeoff.

DRAWINGS

A preferred embodiment of this launcher for radio controlled flights of a model airplane, where, upon the depression of a foot pedal, rotatable, releasible, restraining, spaced arms are cleared for their forward pivotal motion to fall clear of the forward starting taxiing and takeoff motions of the model airplane, is illustrated in the drawings, wherein.

Figure 10:
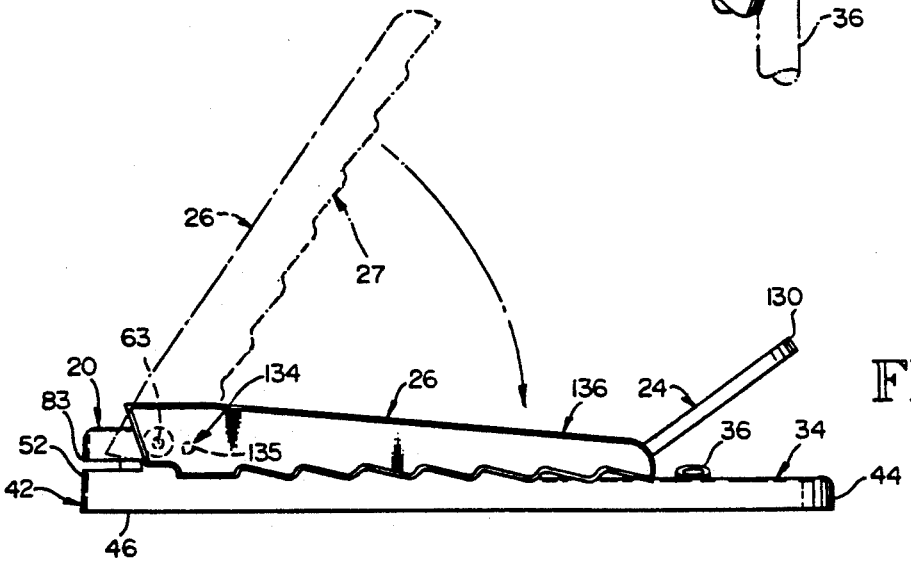
Figure 8:
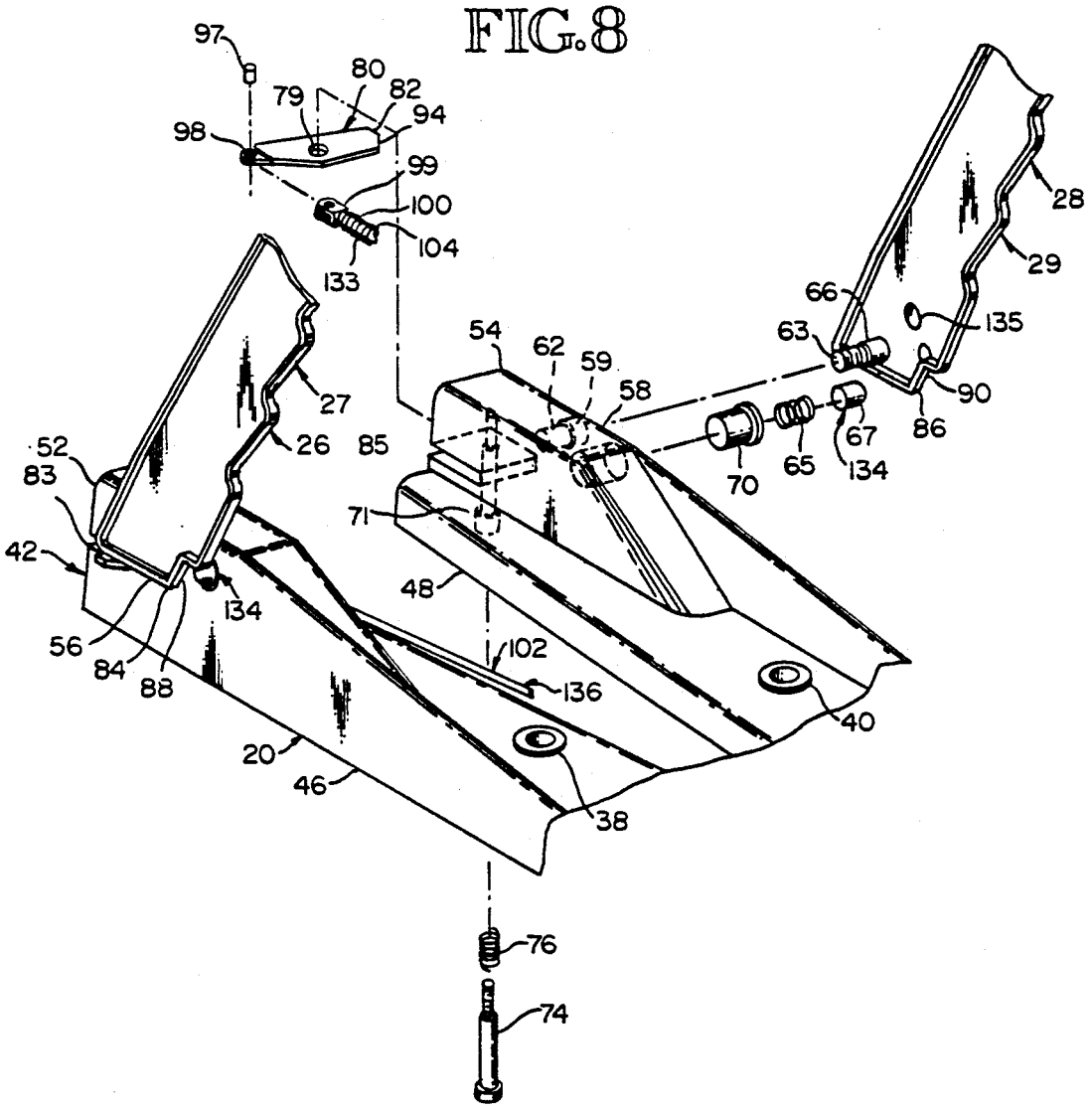
FIG. 8 is a partial exploded view of the interrelated portions of the rotatable, releasible, restraining, spaced, arms, the pivotal locking levers, the horseshoe-like shaped base, the returning force coiled spring, and the linkage system.
Figure 11:
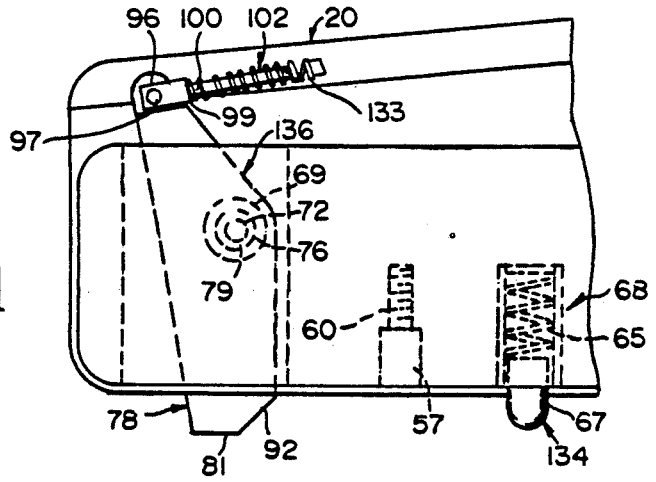

FIG. 10 is a partial side view, with some portions removed, to illustrate how, when the launcher is to be stored for a while, or carried to and from a launching site, the rotatable, releasible, restraining, spaced, arms are rotated back and down to the base, and so retained by spring force catches; and FIG. 11 is an enlarged view of the free end of the heel of the base of the launcher to illustrate a pivotal locking lever, a returning force coiled spring assembly, and other components of the mechanical positive release mechanism.

DESCRIPTION OF THE PREFERRED EMBODIMENT

Figure 1:
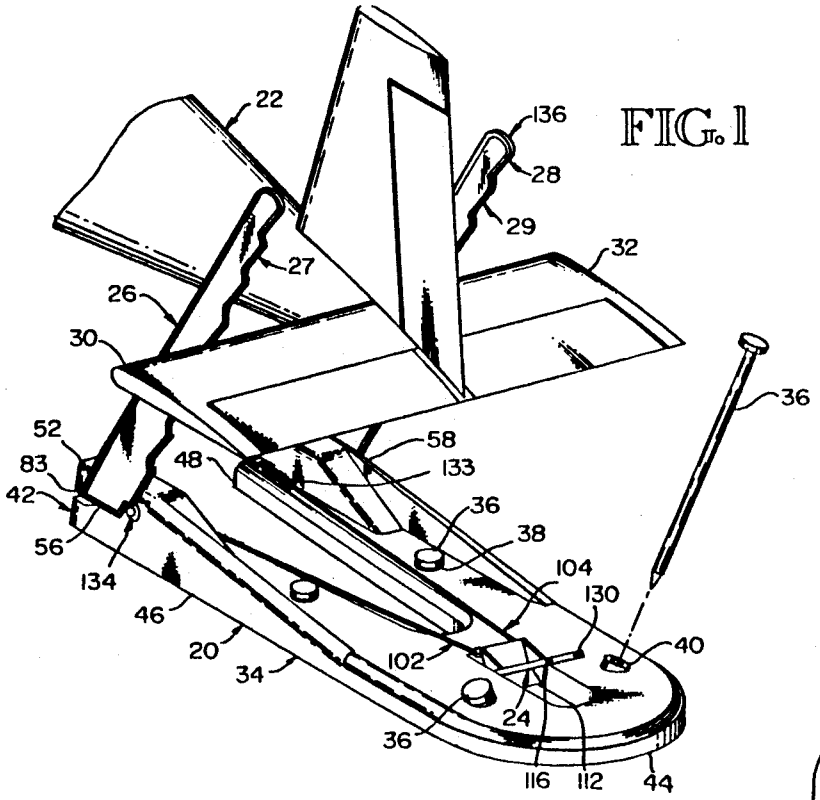
FIG. 1 is a perspective view illustrating how this launcher is holding a model airplane during the preparations for the takeoff and flight thereof.
Figure 2:
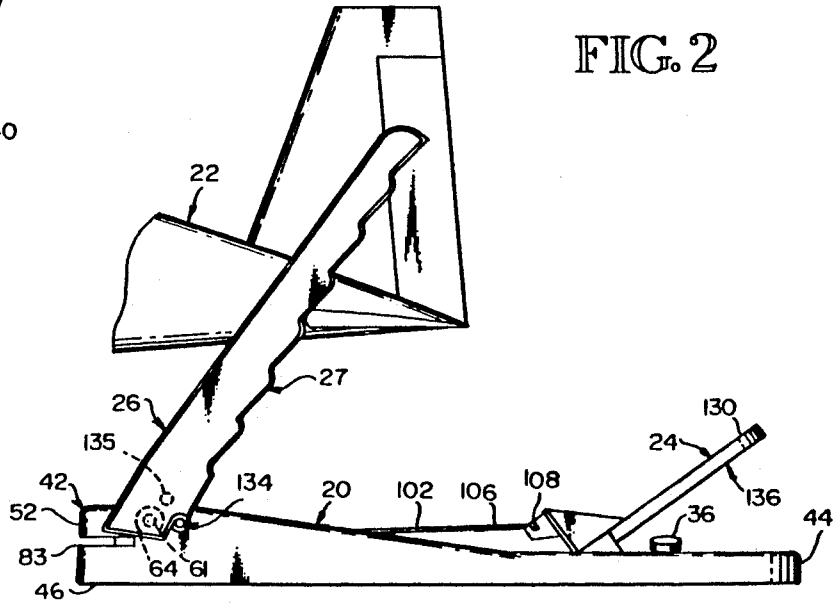
FIG. 2 is a partial side elevational view, with portions removed and/or broken away to further illustrate how the model airplane is being held before takeoff thereof.
Figures 3, 4, 5:
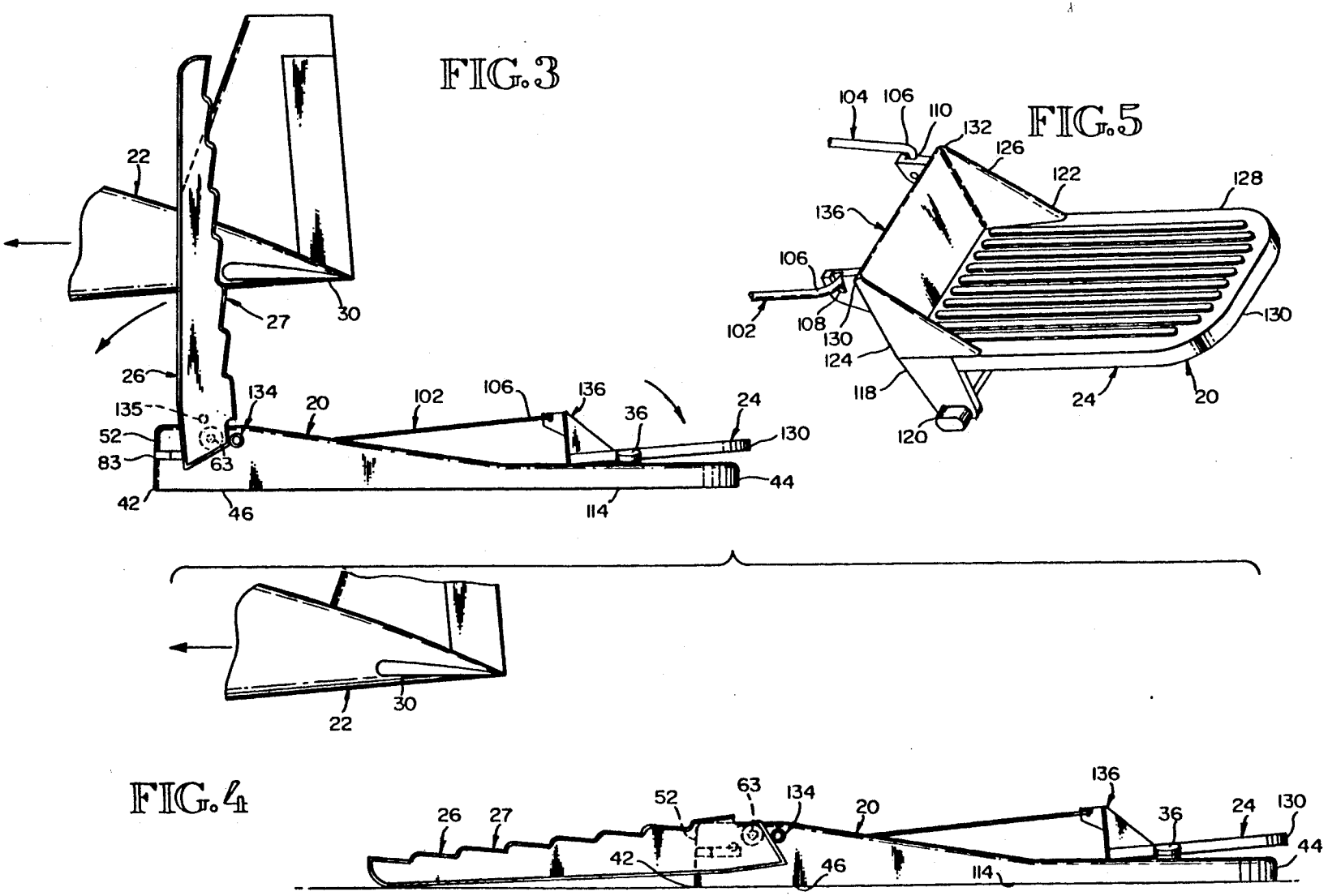
FIG. 3 is a partial side elevational view, similar to FIG. 2, showing, however, the starting motions of the model airplane and starting the clearing and releasing motions of this launcher, as the foot pedal is being depressed.
FIG. 4 is a partial side elevational view, similar to FIGS. 2 and 3, showing, however, the completed clearing and releasing motions of this launcher, as the foot pedal has been fully depressed and so held, until the stabilizers of the model airplane have been well cleared.
FIG. 5 is a perspective view of the releasing foot pedal.
Figure 6:
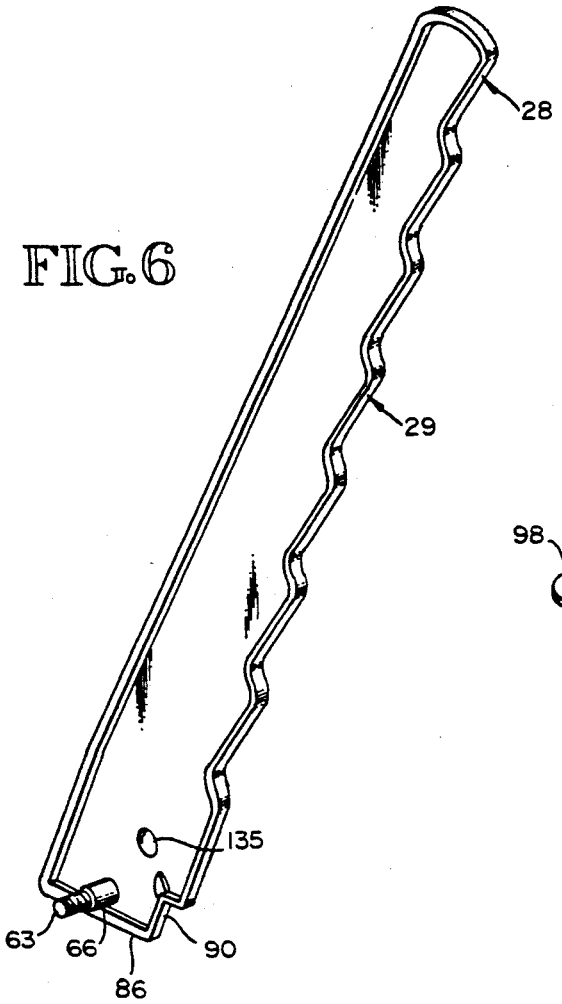
FIG. 6 is a perspective view of one of the rotatable, releasible, restraining, spaced arms.
Figure 7:
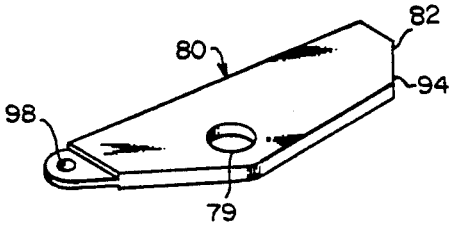
FIG. 7 is a perspective view of one of the pivotal locking levers.

A preferred embodiment of this launcher 20, is illustrated in the drawings, which holds and then releases a radio controlled model airplane 22, without the pilot, an assistant, or an observer, needing to bend down close to the model airplane into the engine exhaust stream, because any one of them may operate a foot pedal 24 on the launcher 20 to clear the model airplane 22 for taxiing and/or takeoff. Before the foot pedal 24 is depressed, the model airplane 22 is held in place by the launcher 20, as illustrated in FIGS. 1 and 2 of the drawings. Rotatable, releasible, restraining, spaced arms 26, 28, are locked in their respective upwardly bias restraining positions. The respective stabilizers 30, 32, of the model airplane 22 bear against these arms 26, 28, during the pre-flight preparations of the radio controlled model airplane 22. Then, when the model airplane 22 is ready for flight, these arms 26, 28 are cleared, so they may rotate forwardly and then downwardly clear of the then forward moving stabilizers 30, 32, of the forward moving model airplane 22, being controlled, via the radio signals created by the pilot. The clearing of the arms 26, 28, is initiated upon the depressing and then holding down the foot pedal 24.

In FIGS. 1, 2, 3, and 4, the respective arrangements of the various components of the launcher 20 are illustrated in specific reference to the holding of the model airplane 22, during the preparations for flight, and then the releasing of the model airplane 22 for taxiing and/or takeoff.

The base 34 is made large enough to be adequately staked to ground, and to accommodate airplane models 22 having horizontal stabilizers 30, 32, which are from two inches to twelve inches above ground level and which span twelve inches, when being positioned with respect to the launcher 20. The rotatable, releasible, restraining, spaced arms 26, 28, are preferably either thirteen inches in length for holding larger model airplanes 22, or seven inches in length for holding smaller model airplanes 22.

Figure 9:
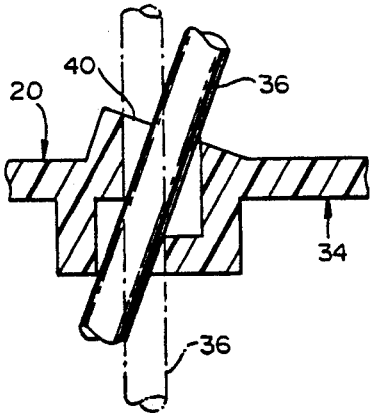
FIG. 9 is a cross sectional view of a ground stake receiving hole structure of the horseshoe-like shaped base, which optionally receives a driven ground stake, which is positioned either perpendicularly or on a bias.

The base 34 is also preferably made as a horseshoe-like shaped base 34 for planar placement on ground and held in place upon the driving of ground stakes 36, preferably ten inches long, through stake receiving hole structures 38, accommodating ground stakes 36 driven vertically, and through stake receiving hold structures 40, accommodating ground stakes 38 driven either vertically or on a bias, as illustrated in FIGS. 1 and 9. When ground stakes 36 are driven on a bias through stake receiving hold structures 40, their angular position is at twenty degrees with respect to a vertical direction, thereby laying the basis for a so called resistive pinching moment.

The open heel end 42, or forward end 42, of this horseshoe base 34 is arranged to point in the direction of the intended first movements of the model airplane 22. The curved toe end 44, or back end 44, of this horseshoe base 34 serves to support the releasing foot pedal 24. The extending spaced heels 46, 48 of this horseshoe base, provide a clear passageway 50 for the movement of any tail wheel, not shown, or other depending structure, of a departing model airplane 22. Near the respective free ends 52, 54 of the extending spaced heels 46, 48, are the mounting locales 56, 58, for the rotatable, adjustable, releasible, restraining, spaced arms 26, 28, which when raised obstruct any forward motion of the model airplane 22, as the respective stabilizers 30, 32 thereof bear against them. These arms 26, 28 each have a multiple notch-like rear edge structure 27, 29, utilized to keep the stabilizers 30, 32 in their initially selected horizontal position.

The base 34, at the mounting locales 56, 58, has respective integral receiving holes 57, 59 with threaded bearing inserts 60, 62 to receive the respective shafts 61, 63 secured to arms 26, 28, via the respective integral shaft receiving structures 64, 66. Also the base 34 has respective depressible, ball type, coil spring abutment structures 68, 70, to position the arms 26, 28, in their restraining positions for contact by the stabilizers 30, 32. The coil springs 65 tend to keep the balls 67 in their abutment positions. In addition, at these mounting locales 56, 58, the base 34 has integral receiving structures 69, 71 to position upstanding shafts 72, 74, each of which is secured respectively to these receiving structures 69, 71 by using an imbedded threaded bearing insert 76, which is also referred to as a bushing 76. Then these shafts 72, 74, each receive a pivoting locking lever 78, 80, via the central holes 79 thereof, for the horizontal plane rotation thereof, into and out of engagement at one cammed end 81, 82, thereof, with the pivoted mounted end 84, 86 of each arm 26, 28. The base 34 has slots 83, 85 which provide clearance for the pivoting locking levers 78, 80. The cam surface structure 88, 90, of each arm 26, 28, is contacted by the cam surface structure 92, 94 of each pivoting locking lever 78, 80.

The pivoting locking lever 78, 80, has at the other end thereof a receiving hole structure 96, 98, to receive, via fasteners 97, 99, a back or heel end 100 of a respective operating cable 102, 104, having a front, forward, or toe, end 106, that is received in a receiving hole structure 108, 110, in foot pedal 24. The base 34 has a receiving volume structure 112 formed with two shaft bearing supports 114, 116, to receive a depending portion 118 of the foot pedal 24, on which are shaft portions 120, 122, which are respectively supported in the two shaft bearing supports 114, 116.

The foot pedal 24 also has two upstanding spaced portions 124, 126 arranged essentially perpendicularly with the planar top surface structure 128 of the foot pedal 24. At the top portions 130, 132, of each upstanding spaced portion 124, 126, the receiving hole structures 108, 110, are positioned to receive the respective forward, front, or toe, ends 106 of the operating cables 102, 104.

When the foot pedal 24 is pivoted downwardly at the free end 130 thereof, upon a person's foot motion, the operating cables 102, 104 are moved, against the forces created by the coil spring assemblies 133 positioned at the back or heel ends 100 of the operating cables 102 and 104, as particularly shown in FIG. 11. At this time the pivoting locking levers 78, 80, are also being moved sufficiently clear of the rotatable, releasible, restraining, arms 26, 28, so these arms 26, 28 will be readily moved out of the path of stabilizers 30, 32 of the model airplane 22, when the pilot, via radio controls, starts the taxiing and/or takeoff maneuvers of the model airplane 22. However, until the person's foot motion occurs, the coil spring assemblies 133 keep the levers 78, 80 in their respective locking positions.

After the launching of the model airplane 22, these restraining arms 26, 28 are easily returned to their upright restraining positions, or they are rotated completely back down into a horizontal stowed position at the close of the day's flight operations, and so held by utilizing the depressible, ball type, coil spring abutment structures 68, 70, also referred to as spring force catches 134, which interact with the receiving notches 135 on the arms 26, 28.

By using this launcher 20, the pilot of a radio controlled model airplane 22, gains the advantage of wheel chucks used in operations with full size aircraft, to hold his model airplane still during ground testing operations of the engine thereof. The pilot and those assisting him, such as a qualified observer, stay at a safe distance away from the noise level and exhaust fumes of the engine.

When the model airplane 22 is ready for flight, it is released from the positive holding or locking thereof, by utilizing the overall mechanical positive release mechanism 136 of this launcher 20. In this way, the launcher 20 is utilized in full compliance with Academy of Model Aeronautics safety requirements which require that the pilot/operator must be in control of the model airplane, and that no inadvertent signal can release the model airplane, such as some other pilot's transmittal radio signal.

I claim:

1. A launcher for radio controlled flights of a model airplane, which holds and then releases a model airplane, without the pilot, an assistant, or an observer, needing to bend down close to the model airplane into the engine exhaust stream to release the model airplane from the launcher, because any one of them by operation of a foot pedal located at the rear of the launcher can clear the model airplane for taxiing and/or takeoff, comprising:

a. a horseshoe-like shaped base for placement on the ground, an open heel end of this horseshoe base being pointed in the direction of intended first movements of the model airplane, and always remaining well clear of any portions of the released model airplane and only extending alongside the end of a fuselage of a model airplane which is in the launching position, a curved toe end of this horseshoe base serving to support the releasing foot pedal, located beyond the rear of the end of a fuselage of a model airplane, extending spaced heels of this horseshoe base providing a clear passageway between them for the exiting tail wheel of a model airplane, and providing at their heel ends, respective mounting locales for rotatable, adjustable, releasible, restraining, spaced arms, which, when raised in their upright restraining positions, obstruct any forward motion of a model airplane, as the respective stabilizer portions of this model airplane bear against these respective restraining spaced arms;

b. a releasing foot pedal pivotally secured to the horseshoe-like shaped base at the curved toe end thereof, and thereby located beyond the rear end of a fuselage of a model airplane;

c. rotatable, releasible, restraining, spaced arms pivotally secured respectively at the mounting locales at the heel ends of the extending spaced heels of the horseshoe-like shaped base, which are releasibly held in their upright restraining positions, when respective stabilizer portions of the model airplane bear against them, until the depression of the releasing foot pedal;

d. a linkage system interconnecting the releasing foot pedal and the rotatable, releasible, restraining arms, which, upon depression of the releasign foot pedal, clears the way for the rotation of the previously held rotatable, releasible, restraining, spaced arms, to permit them to clear themselves from the pathway of the departing respective stabilizer portions of the model airplane, when the pilot, by radio controls, is directing the model airplane away from this launcher, after he or she, an assistant, or an observer, has at the outset depressed the foot pedal, after the pilot had decided the model airplane was ready for taxiing, takeoff, and flight.

2. A launcher for a radio controlled flight of a model airplane, as claimed in claim 1, wherein the linkage system has pivoting locking levers respectively located at the mounting locales of the rotatable, releasible, restraining, spaced arms, one end of each pivoting locking lever being moved under a rotatable, releasible, restraining, spaced arm, at the pivotally secured end thereof, to keep this spaced arm from rotating out of the restraining position thereof, and the other end of each pivoting locking lever being interconnected with the releasing foot pedal, whereby upon the depression of this foot pedal, the respective one ends of the pivoting locking levers are cleared away from the pivotally secured ends of the respective rotatable, releasible, restraining, spaced arms, which thereafter can be moved clear by the stabilizer of the advancing model airplane, then being radio controlled by the pilot in preparation for takeoff.

3. A launcher for a radio controlled flight of a model airplane, as claimed in claim 2, wherein the linkage system has respective return force spring assemblies positioned to return each of the one ends of each of the pivoting locking levers back under the respective rotatable, releasible, restraining, spaced arms at their pivotal secured ends thereof, to keep these spaced arms from rotating out of their restraining positions.

4. A launcher for a radio controlled flight of a model airplane, as claimed in claim 3, wherein the respective return force spring assemblies of the linkage system are each a respective coiled spring anchored between a respective pivoting locking lever and the horseshoe-like shaped base.

5. A launcher for radio controlled flight of a model airplane, as claimed in claim 4, wherein the linkage system has respective pulling cables interconnecting the respective other ends of the pivoting locking levers with the releasing foot pedal.

6. A launcher for radio controlled flight of a model airplane, as claimed in claim 1, wherein the rotatable, releasible, restraining, spaced arms, each have complementary series of notches, whereby the stabilizers of the tail of the model airplane will be positioned in a respective notch, when a model airplane is being locked into place on this launcher, and thereafter during this locked in place time, the stabilizers will not slide down along the respective rotatable, releasible, restraining, spaced arms, thereby avoiding the tilting up of the model airplane, placing the turning propeller in a more hazardous position.

7. A launcher for radio controlled flight of a model airplane, as claimed in claim 2, wherein the rotatable, releasible, restraining, spaced arms, each have complementary series of notches, whereby the stabilizers of the tail of the model airplane will be positioned in a respective notch, when a model airplane is being locked into place on this launcher, and thereafter during this locked in place time, the stabilizers will not slide down along the respective rotatable, releasible, restraining, spaced arms, thereby avoiding the tilting up of the model airplane, placing the turning propeller in a more hazardous position.

8. A launcher for radio controlled flight of a model airplane, as claimed in claim 5, wherein the rotatable, releasible, restraining, spaced arms, each have complementary series of notches, whereby the stabilizers of the tail of the model airplane will be positioned in a respective notch, when a model airplane is being locked into place on this launcher, and thereafter during this locked in place time, the stabilizers will not slide down along the respective rotatable, releasible, restraining, spaced arms, thereby avoiding the tilting up of the model airplane placing the turning propeller in a more hazardous position.

9. A launcher for radio controlled flight of a model airplane, as claimed in claim 1, wherein the horseshoe-like shaped base for placement on the ground has multiple through passageway structures to receive ground stakes.

10. A launcher for radio controlled flight of a model airplane, as claimed in claim 8, wherein the horseshoe-like shaped base for placement on the ground has multiple through passageway structures to receive ground stakes.

11. A launcher for radio controlled flight of a model airplane, as claimed in claim 1, wherein the horseshoe-like shaped base for placement on the ground has four through passageway structures to receive the ground stakes, with two of them being located in the curved toe end, and each of the remaining two of them being located in a respective extending spaced heel.

12. A launcher for radio controlled flight of a model airplane, as claimed in claim 8, wherein the horseshoe-like shaped base for placement on the ground, has four through passageway structures to receive the ground stakes, with two of them being located in the curved toe end, and each of the remaining two of them being located in a respective extending spaced heel.

13. A launcher for radio controlled flight of a model airplane, as claimed in claim 11, wherein the two passageways formed in the curved toe end, are each arranged to receive and position a ground stake, either in the upright or the angular position thereof.

14. A launcher for radio controlled flight of a model airplane, as claimed in claim 12, wherein the two passageways formed in the curved toe end, are each arranged to receive and position a ground stake, either in the upright or the angular position thereof.

15. A launcher for radio controlled flight of a model airplane, as claimed in claim 9, having ground stakes to pass through the passageway structures.

16. A launcher for radio controlled flight of a model airplane, as claimed in claim 10, having 9round stakes to pass through the passageway structures.

17. A launcher for radio controlled flight of a model airplane, as claimed in claim 2, wherein each of the one ends of each pivoting locking lever has a cooperating biased cam surface structure, and each of the pivotal secured ends of the rotatable, releasible, restraining, spaced, arms has a cooperating biased cam surface structure, to interact with the cooperating biased cam surface structure of the pivoting locking lever, during both the locking and releasing motions of the pivoting locking levers and the rotatable, releasible, restraining, spaced arms.

18. A launcher for radio controlled flight of a model airplane, as claimed in claim 3, wherein each of the one ends of each pivoting locking lever has a cooperating biased cam surface structure, and each of the pivotal secured ends of the rotatable, releasible, restraining, spaced arms has a cooperating biased cam surface structure, to interact with the cooperating biased cam surface structure of the pivoting locking lever, during both the locking and releasing motions of the pivoting locking levers and the rotatable, releasible, restraining, spaced arms.

19. A launcher for radio controlled flight of a model airplane, as claimed in claim 5, wherein each of the one ends of each pivoting locking lever has a cooperating biased cam surface structure, and each of the pivotal secured ends of the rotatable, releasible, restraining, spaced arms has a cooperating biased cam surface structure, to interact with the cooperating biased cam surface structure of the pivoting locking lever, during both the locking and releasing motions of the pivoting locking levers and the rotatable, releasible, restraining, spaced arms.

20. A launcher for radio controlled flight of a model airplane, as claimed in claim 6, wherein each of the one ends of each pivoting locking lever has a cooperating biased cam surface structure, and each of the pivotal secured ends of the rotatable, releasible, restraining, spaced arms has a cooperating biased cam surface structure, to interact with the cooperating biased cam surface structure of the pivoting locking lever, during both the locking and releasing motions of the pivoting locking levers and the rotatable, releasible, restraining, spaced arms.

21. A launcher for radio controlled flight of a model airplane, as claimed in claim 1, wherein, when flying operations are completed, the rotatable, releasible, restraining, spaced arms are rotated back and down to the launcher.

22. A launcher for radio controlled flight of a model airplane, as claimed in claim 21, wherein these arms when rotated back and down to the launcher are so held in place by spring force catches.

* * * * *